United States Patent [19]

Macaleese

[11] 4,437,279

[45] Mar. 20, 1984

[54] THERMALLY INSULATED TANK STRUCTURE AND METHOD FOR FORMING THE SAME

[75] Inventor: John E. Macaleese, Watertown, N.Y.

[73] Assignee: Stebbins Engineering and Manufacturing Co., Watertown, N.Y.

[21] Appl. No.: 348,246

[22] Filed: Feb. 12, 1982

[51] Int. Cl.[3] ..... E04B 1/32

[52] U.S. Cl. ..... 52/247; 52/249; 52/309.12; 52/425; 52/747

[58] Field of Search ..... 52/743, 747, 741, 247, 52/249, 309.12, 425; 264/31, 32, 34

[56] References Cited

U.S. PATENT DOCUMENTS

| | | | |
|---|---|---|---|
| 2,418,580 | 4/1947 | Crom | 264/32 |
| 3,433,382 | 3/1969 | Boggio | 220/3 |
| 3,591,443 | 5/1971 | Cox | 428/47 |
| 3,753,848 | 8/1973 | Bennett | 428/179 |
| 3,769,118 | 10/1973 | Tariel et al. | 156/71 |
| 3,860,478 | 1/1975 | Bartlow et al. | 428/63 |
| 4,009,236 | 2/1977 | Katsuta | 264/453 |
| 4,044,517 | 8/1977 | Schroter | 52/248 |
| 4,069,642 | 1/1978 | Hendriks | 52/224 |
| 4,077,177 | 3/1978 | Boothroyd | 52/741 |
| 4,155,787 | 5/1979 | De Sadier | 52/249 X |

*Primary Examiner*—Carl D. Friedman

*Attorney, Agent, or Firm*—Sixbey, Friedman & Leedom

[57] ABSTRACT

A large volume, thermally insulated tank is formed by constructing the tank sidewall in superimposed sections. Each section is constructed without the use of external support forms by laying a first outer course of thermal insulating material and then forming a first inner course of refractory material spaced therefrom. The cavity between these two courses is then filled with cementitious material, and the process is repeated until a tank wall of the desired height is completed. The resultant tank wall will have an outer layer of light, thermal insulating material, an inner layer of refractory material and a core of cementitious material joining the two layers.

17 Claims, 3 Drawing Figures

THERMALLY INSULATED TANK STRUCTURE AND METHOD FOR FORMING THE SAME

TECHNICAL FIELD

The present invention relates to large volume, thermally insulated tank structures and a novel method for constructing such tank structures without the use of supporting forms.

BACKGROUND ART

Insulated storage tanks for storing fluids at temperatures substantially independent of the ambient environment are widely used, particularly in northern climates. Generally, the construction of insulated tank structures for outdoor use involves the employment of heavy materials and complex support forms, thereby producing high labor and material costs which render such tanks expensive.

In the past, effective insulated storage tanks have been constructed from blocks of insulating material, such as Foamglas, a product of Pittsburgh Plate Glass Company. These blocks are set in place using hot pitch asphalt as the bonding agent between individual blocks. Subsequently, an asphalt coating combined with open mesh fiberglas cloth is used as an outer covering to protect the blocks from the elements and physical damage. Considerable labor costs are incurred in the construction of such tanks, for not only is asphalt difficult to work with, but the dangers involved in applying asphalt by hand to the blocks provides some hazard in the construction process.

Another known method for forming insulated tanks involves the use of cementious insulating block. In general, such block is an expanded shale or pumice which may weigh as much as 90 lbs. per cubic foot. This block, when treated on the exterior with a repellant material or a masonary type latex base paint, provides a tank with very dense walls and good thermal insulating characteristics, but construction costs are excessive due to the equipment and labor needed to handle such heavy block.

Ideally, lightweight foam insulation can be employed in the construction of large volume insulated tank structures, and methods for installing lightweight foam as an insulator are disclosed in U.S. Pat. Nos. 3,753,848 and 4,077,177. Unfortunately, where large volume, insulated tanks are required which have the capability of withstanding great internal hydrostatic pressure, it is necessary to provide the foam insulated tank with a strong, reinforcing core of cement or similar material. In the past, it has been necessary to first provide a structural form to support and reinforce the concrete core which is poured to form the basic tank structure. Then, the form is removed and insulating material is laid around the periphery of the concrete core. The necessity to deal with the tremendous weights involved in pouring a complete concrete tank and to provide the required form and support structures for this concrete has contributed to high labor and material costs for tank construction.

DISCLOSURE OF INVENTION

It is a primary object of the present invention to provide a new and improved method for constructing a large volume, thermally insulated tank using lightweight sheet insulating material.

Another object of the present invention is to provide a new and improved method for constructing a thermally insulated tank structure using lightweight sheet insulating material as a tank outer face with a tile/brick layer as a tank inner face. Strength is imparted to the tank wall by providing a reinforced concrete core between the insulated tank outer face and the tile inner face, and the complete tank is formed without the use of separate support forms.

A further object of the present invention is to provide a novel and improved method for forming a thermally insulated tank structure having a tank wall which includes an outer layer of light insulating foam material, a central core of reinforced concrete material, and an inner face of tile/brick material. In accordance with this method, the tank wall is formed by constructing a plurality of successive, superimposed courses, or sections, thus permitting the concrete core to be poured and compacted without the use of external forms.

A still further object of the present invention is to provide a new and improved large volume thermally insulated tank structure which includes a tank wall formed with an outer layer of lightweight, thermally insulating, foam material having a hard, waterproof outer surface. Spaced from the insulating outer layer is an inner layer or face formed from tile/brick, and these inner and outer layers are joined by a dense central core formed of reinforced concrete.

A still further object of the present invention is to provide a novel and improved insulated storage tank structure and method for forming the same wherein the tank walls are successively formed as individual, superimposed courses. Initially, a first course is formed by bonding elongated planks of thermal insulation material onto a foundation slab to define the outer perimeter of the tank. These planks are joined end to end by horizontally disposed metal pins extending between the ends of the planks while the planks are glued to the foundation slab and glue is also placed between adjacent ends of the planks. A fiber-filled mortar is then applied to the outer surface of the first course of insulating planks to protect the soft plank layer and enhance the bond between individual planks. When the outer insulating layer is completed, a course of tile is laid on the foundation slab to define the inner perimeter of the tank and to also define a central cavity between the tile and the insulating layers which extends completely around the wall of the tank. This cavity is filled with reinforced, compacted concrete to provide a dense, strong core capable of withstanding high internal hydrostatic pressures which might be applied to the tank wall. The tank wall is then completed by successively constructing identical courses on top of the first course until a desired height is reached.

These and other objects of the present invention will become readily apparent upon a consideration of the following specification and claims taken in conjunction with the accompanying drawings.

BEST MODE FOR CARRYING OUT THE INVENTION

Figure 1:
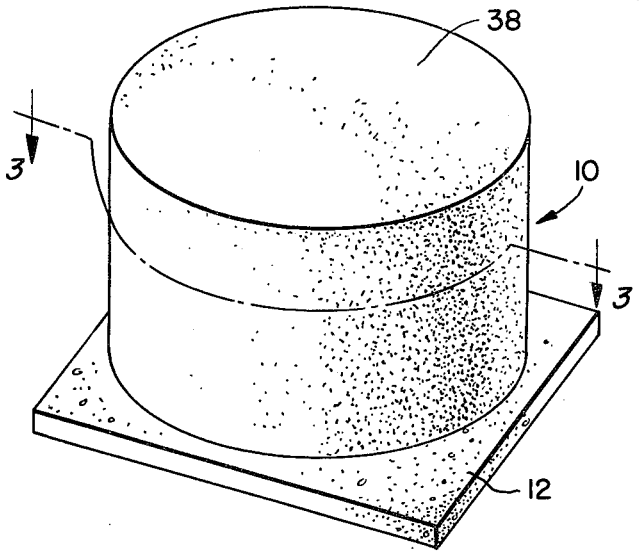
FIG. 1 is a perspective view of the thermally insulated tank of the present invention.
Figure 3:
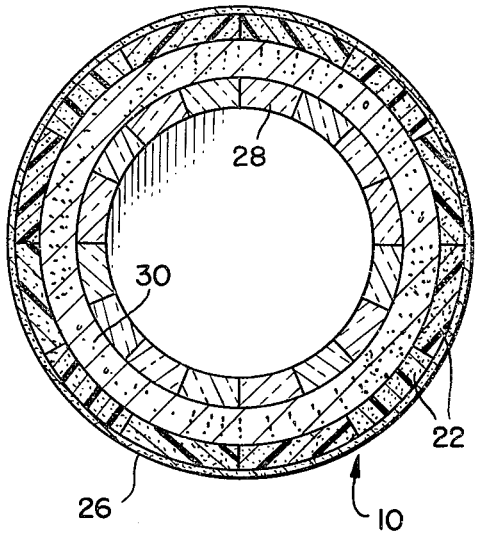
FIG. 3 is a sectional plan view of the insulated tank of the present invention taken along lines 3—3 of FIG. 1.
Figure 2:
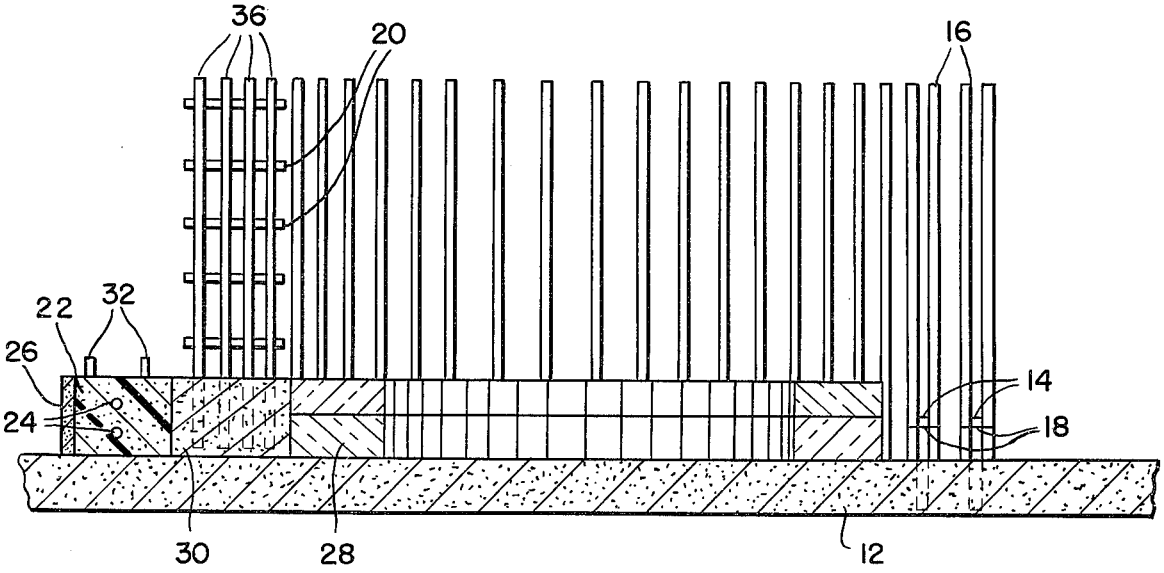
FIG. 2 is a partially sectioned view showing a portion of the tank of the present invention during the construction of the first section of the side wall thereof.

Referring now to the drawings, the novel thermally insulated tank unit of the present invention indicated generally at 10 is constructed on a reinforced concrete base or foundation 12. During the formation of this foundation, vertically projecting steel dowels 14 are embedded in the concrete in an area which will be substantially central of the side wall for the tank 10 and in a configuration approximating the configuration of the tank side wall. In the instant drawings, this tank side wall indicated at 14 is circular in cross-section, but the tank side wall may be formed to any desired configuration employing the novel method of this invention.

The thermally insulated tank 10 is designed to contain a hydrostatic head of at least specific gravity 1 or greater, and by employing the construction method of the present invention, this tank can be formed to withstand high hydrostatic pressures without the use of external support forms or the necessity to handle extremely heavy construction materials. In the formation of the tank, a concrete reinforcing structure is first secured to the projecting dowels 14. This reinforcing structure may take any form required by the configuration of the concrete to be supported and reinforced, but basically will include vertically extending rods 16 which are suitably secured at 18 to the dowels 14. Subsequently, horizontally extending reinforcing rods 20 are secured in a known manner to the vertically extending rods 16 to provide the desired reinforcing structure. The initial reinforcing structure does not extend upwardly from the base 12 for the full height of the tank 10, but instead only a first course of the reinforcing structure is formed which, for example, may be five to six feet in height.

Once the concrete reinforcing structure is in place, a first course of elongated planks of thermal insulating material are laid on the base 12 to define the outer periphery of the tank. These planks, which may be formed of known thermal insulating material such as urethane foam, are conventionally formed in eight foot lengths with a vertical height of two feet. The planks, which are indicated at 22, are cemented or otherwise suitably adhered to the base 12, and horizontally extending attaching pins 24 are inserted in the ends of each plank in the first course of planks attached to the concrete base. These plank ends are secured together by the pins 24 and suitable adhesive material applied thereto, and the planks are laid until an enclosed first course of planks is completed in the desired configuration for the tank 10. Once this first course of planks is in place, a layer of fiber-filled hydraulic mortar 26 is plastered over the entire exterior of the plank course. The mortar layer acts as a hard, waterproof protective layer over the soft urethane planks to provide protection from external physical damage, and also operates to securely bond the planks together.

The first course of thermal insulating planks 22 is arranged in spaced relationship outwardly from the concrete reinforcing structure formed by the reinforcing rods 16 and 20, and once this course is completed, construction of the tank interior is initiated. To enable the tank 10 to contain materials such as corrosive chemicals, the interior wall of the tank is provided with a tile/brick surface. Ideally, the individual tiles employed in the formation of this interior wall are approximately one-half the height of the urethane insulating planks 22 and thus, for example, when a two foot high insulating plank is employed, a suitable tile for the internal tank wall might be twelve inches in height, nine inches in width and one inch thick. The ceramic tile/brick 28 is laid on the base 12 inwardly and in spaced relationship to the reinforcing structure formed by the reinforcing rods 16 and 20 to define an enclosed first course of tile/brick positioned inwardly but equally spaced from the first course of planks 22. The tile are laid in a conventional manner using mortar joints so that a solid tile inner face is formed on the base 12. Once the mortar is set, a concrete core 30 is installed between the first course of insulating planks 22 and the first course of tile 28.

The concrete core 30 will be formed from a minimum of 3,000 psi test concrete which is poured into the cavity between the first course of tile 28 and the first course of planks 22. It should be noted that the concrete will be poured only to the height of the first course of tile, which, for example, may be twelve inches, so that the tile course and plank course are of sufficient strength to act as a supporting form for the concrete. This eliminates the necessity to build and then tear down elaborate supporting forms for the concrete core.

After a layer of concrete has been poured to the height of the first course of tile 28, the concrete is consolidated by the use of a vibrator or similar means, and once set, provides a solid support core extending between the tile course and the thermal insulation plank course. With the concrete set, a second course of tile 28 is laid, and a second layer of concrete is poured over the first layer to fill the cavity between the second course of tile and the first course of planks 22. The second layer of concrete is then compacted and set so that a complete section of tank wall is formed equal in height to the height of the urethane planks 22.

Once a tank base wall section is formed to an even height and contains, for example, a single course of externally coated urethane planks and an inner wall containing two courses of tile with an intervening core of reinforced concrete, construction of a second superimposed section of the tank wall may be initiated. To accomplish this, vertical metal pins 32 are first inserted in the top of the first course of insulating planks 22 along the length of the entire first course. Then the top surface of the first course of insulating planks is coated with a suitable adhesive, and a second course of insulating planks is superimposed thereon. The first course and second course are joined by the adhesive and the vertically extending pins 32 which project into the planks of the second course. Now the second course of planks is coated to form the outer layer 26, and a third course of tile is laid upon the second course of tile so that the concrete core may be formed to the upper level of this course. After the concrete core is poured and compacted, a fourth course of tile is laid and concrete is added to bring the core up to the level of the two courses of urethane plank. This procedure is repeated until the tank wall reaches a desired height.

When the courses of tile and urethane plank joined by the concrete core approach the upper ends 36 of the vertical reinforcing rods 16, an additional group of vertical reinforcing rods are tied to the lower group 16 and provided with attached horizontal reinforcing rods 20. Thus, the reinforcing rod structure, the tile inner face, the concrete core, and the outer mortar coated thermal insulating plank face of the tank are sequentially constructed in superimposed courses until the desired tank height is reached. At this point, the tank may be left open or any suitable top or cover 38 may be attached to the upper edge of the tank side wall to provide an enclosed tank.

It will be apparent that the insulated tank 10 constructed in accordance with the novel method of present invention is an extremely compact and strong tank due to the high density concrete core 30 which completely fills the area between the inner tile wall and the thermal insulating layer and forms a unitary structure therewith. By using the thermal insulating planks and the tile wall as a form for the concrete core, not only is the expensive and time consuming procedure of constructing and subsequently tearing down external support forms eliminated, but also the concrete core conforms exactly to the configuration of the tile and thermal insulating layers and adheres thereto to provide a unitary structure. Thus a unitary tank wall of enhanced strength results.

INDUSTRIAL APPLICABILITY

The thermally insulated tank 10 of the present invention may be conveniently formed of lightweight planks of insulation combined with ceramic tiles which are individually light in weight. These materials may be easily handled manually, and the entire tank structure is constructed without the use of external supporting forms. Once the tank is constructed, it is adapted to withstand high internal hydrostatic pressures and to contain corrosive chemical substances. The tank may be cylindrical in configuration as shown in the drawings, but rectangular, square, or tanks of other configurations may be formed in accordance with this invention.

I claim:

1. A method for constructing a thermally insulated tank structure in a plurality of superimposed, sequential sidewall sections without the use of external support forms which includes:

(a) constructing a base sidewall section by
  (1) forming a first, outer course of thermal insulating material to provide a first enclosed structure in substantially the desired configuration of the outside of the tank sidewall and of a height which is substantially less than the desired height of the tank sidewall;
  (2) forming a first inner course of refractory block material to form a second enclosed structure spaced inwardly from said first enclosed structure to provide a cavity therebetween which extends completely around the periphery of said second enclosed structure;
  (3) filling said cavity with a cementitous material to form a central core extending between and completely filling the space between said first and second enclosed structures; and (b) individually and sequentially constructing superimposed sections above said base sidewall section until the desired tank sidewall height is reached, each superimposed section being constructed by
  (1) forming an outer course of thermal insulating material which is secured to and overlies the course of thermal insulating material in the adjacent underlying sidewall section, each said individual outer course of thermal insulating material being formed to a height which is substantially less than the desired height of said tank sidewall;
  (2) forming an inner course of refractory block material which is secured to and overlies the course of refractory block material in the adjacent underlying sidewall section to provide a cavity between said outer and inner courses which extends completely around the periphery of said inner course, the bottom of said cavity being formed by the central core of said adjacent underlying sidewall section, and
  (3) filling said cavity with a cementitious material to form a central core extending between and completely filling the space between said outer and inner courses.

2. The method of claim 1 which includes applying an outer layer of hard, waterproof material to the outer surface of the outer course of each of said sidewall sections to protect and bond said thermal insulating material.

3. The method of claim 2 which includes forming a top for said tank secured to the uppermost sidewall section of the tank sidewall.

4. The method of claim 2 wherein said outer layer is formed by applying a fiber filled mortar to said outer course.

5. The method of claim 1 wherein said outer courses of thermal insulating material are formed by elongated sheet planks of urethane.

6. The method of claim 1 wherein said inner courses of refractory block material include ceramic tile joined by mortar joints.

7. A method for constructing a thermally insulated tank structure having a concrete core on a preformed foundation without the use of external support forms which includes:

(a) constructing a first concrete reinforcing structure secured to said foundation and extending upwardly therefrom in a configuration substantially corresponding to the intended configuration of said concrete core, (b) forming a base sidewall section on said foundation by:
  (1) securing a plurality of elongated planks of thermal insulating material to said foundation and end to end to form a first enclosed structure spaced outwardly from said concrete reinforcing structure and conforming substantially to the desired configuration of the outside periphery of the tank sidewall to provide a first outer course of thermal insulating material of a height which is substantially less than the desired height of the tank sidewall,
  (2) applying an outer layer of fiber filled mortar to the outer surface of said first outer course,
  (3) forming a first inner course of refractory block material secured to said foundation and spaced inwardly from said concrete reinforcing structure, said refractory block material being arranged to form a second enclosed structure which extends from said foundation to a height which is no more than one half the height of said first outer course of thermal insulating material,
  (4) filling the area between said enclosed inner and outer structures with cementitious material,
  (5) forming at least one additional course of refractory block material superimposed on said second enclosed structure of refractory block material to raise the height of said first inner course to the level of said first outer course, and (6) filling the remaining area between said first inner and outer courses with cementitious material to complete a central core of a height substantially equal to that of said first inner and outer courses;

(c) individually and sequentially constructing superimposed sidewall sections above said base sidewall section until the desired tank sidewall height is reached, each such superimposed sidewall section being contstructed by (1) securing a plurality of elongated planks of thermal insulating material in superimposed relationship to the course of thermal insulating planks in the adjacent underlying sidewall section to form an outer course of thermal insulating material (2) applying an outer layer of fiber filled mortar to the outer surface of said outer course of thermal insulating material, (3) forming a lower course of refractory block material secured to and overlying the course of refractory block in the adjacent underlying sidewall section, said lower course of refractory block material extending for a height which is no more than one half the height of said outer course of thermal insulating material, (4) filling the area between said lower course of refractory material and outer course of thermal insulating material with cementitious material to a height substantially equal to that of said lower course of refractory material.

(5) forming at least one additional course of refractory block material superimposed on said lower course of refractory block material to provide an inner course of refractory block material substantially equal in height to said outer course of thermal insulating material, and (6) filling the remaining area between each additional course of refractory block material and the outer course of thermal insulating material with cementitious material to complete a central core of a height substantially equal to the additional course of refractory block material.

8. The method of claim 7 which includes constructing said first concrete reinforcing structure to extend upwardly from said foundation to a height which is substantially less than the desired height of the tank sidewall and individually and sequentially constructing additional concrete reinforcing sections superimposed above said first concrete reinforcing structure until the desired height of said tank sidewall is reached, a second concrete reinforcing section being secured to said first concrete reinforcing structure when the superimposed sidewall sections of said tank sidewall approach the height of said first concrete reinforcing structure, and additional concrete reinforcing sections being individually attached to the adjacent underlying concrete reinforcing section when the superimposed sidewall sections of the tank sidewall approach the height of the adjacent underlying concrete reinforcing section.

9. The method of claim 7 wherein the thermal insulating planks of said base sidewall section are joined end to end by inserting horizontally extending pins into the contacting ends of adjacent planks to extend into said adjacent planks and adhesively bonding said contacting ends together.

10. The method of claim 7 wherein the elongated planks of thermal insulating material in said superimposed sidewall sections are secured to the course of thermal insulating planks in the adjacent underlying sidewall section by inserting elongated pins into the top of the thermal insulating planks of the underlying sidewall section so as to extend vertically therefrom into the thermal insulating planks of the superimposed sidewall section and adhesively bonding the contacting surfaces of the thermal insulating planks of the underlying and superimposed sidewall sections together.

11. The method of claim 10 wherein the thermal insulating planks of said base sidewall section are joined end to end by inserting horizontally extending pins into the contacting ends of adjacent planks to extend into said adjacent planks and adhesively bonding said contacting ends together.

12. The method of claim 11 which includes forming a top for said tank extending from the uppermost sidewall section of the tank sidewall.

13. The method of claim 12 wherein said inner courses of refractory block material include ceramic tile joined by mortar joints.

14. The method of claim 13 wherein said thermal insulat ing planks are elongated sheet planks of urethane.

15. The method of claim 14 which includes compacting the cementitious material after the area between the refractory block material and the outer course of thermal insulating material is filled with such cementitious material during the formation of each superimposed wall section.

16. A thermally insulated tank structure secured to a foundation comprising a tank sidewall secured to the foundation and defining an enclosed tank chamber, said tank sidewall including an outer layer formed from superimposed courses of elongated planks of urethane thermal insulating material, said courses of planks being joined together by adhesive and vertically disposed pins which extend into the planks in adjacent courses, the course of planks in contact with said foundation being joined end to end by adhesive and horizontally disposed pins extending into the ends of adjacent planks, the outer surface of said outer layer being coated with a layer of hard, waterproof material formed of fiber filled mortar, an inner layer extending in substantially parallel spaced relationship to said outer layer, said inner layer being formed from blocks of refractory material, said refractory material being formed by ceramic tile joined by mortar joints, and a reinforced concrete core completely filling the space between said inner and outer layers and being adhered thereto.

17. The thermally insulated tank structure of claim 16 which includes a top wall secured to said sidewall.

* * * * *